US008622877B2

(12) United States Patent
Raines et al.

(10) Patent No.: US 8,622,877 B2
(45) Date of Patent: Jan. 7, 2014

(54) WEIGHTED ARTICLE WITH FILL SPOUT

(75) Inventors: Mark T. Raines, Georgetown, TX (US); Nga Tran Keith, Austin, TX (US); Mai Phuong Tran, Austin, TX (US)

(73) Assignee: Hyper Wear, Inc., Austin, TX (US)

( * ) Notice: Subject to any disclaimer, the term of this patent is extended or adjusted under 35 U.S.C. 154(b) by 145 days.

(21) Appl. No.: 12/511,036

(22) Filed: Jul. 28, 2009

(65) Prior Publication Data

US 2010/0022361 A1 Jan. 28, 2010

Related U.S. Application Data

(66) Substitute for application No. 61/137,172, filed on Jul. 28, 2008.

(51) Int. Cl.
*A63B 21/06* (2006.01)

(52) U.S. Cl.
USPC ..... 482/93; 482/20; 482/50; 383/44

(58) Field of Classification Search
USPC ..... 482/14, 20–23, 44, 49, 50, 79, 92–94, 482/105, 106, 108, 110–112, 121, 139, 140, 482/148, 908; 473/594, 595, 597, 609, 610, 473/611; 273/DIG. 20; 137/223, 844, 852, 137/853; 383/36, 95, 904, 44, 50, 57, 42, 383/43, 903, 2, 84, 85; 141/338; 220/229, 220/240; 297/452.17; 422/78
See application file for complete search history.

(56) References Cited

U.S. PATENT DOCUMENTS

| | | | | | |
|---|---|---|---|---|---|
| 172,039 | A | * | 1/1876 | Lazarevitch | 383/36 |
| 177,749 | A | * | 5/1876 | Redden | 383/36 |
| 1,089,279 | A | * | 3/1914 | Simer et al. | 383/42 |
| 1,909,921 | A | * | 5/1933 | Tompkins | 473/610 |
| 2,616,467 | A | * | 11/1952 | Cicero | 383/16 |
| 2,622,646 | A | * | 12/1952 | Miller | 383/93 |
| 2,696,342 | A | * | 12/1954 | Toborg | 383/44 |
| 2,795,425 | A | * | 6/1957 | Orms | 473/610 |
| 3,144,197 | A | * | 8/1964 | Milner et al. | 383/45 |
| 3,181,439 | A | * | 5/1965 | Valer | 493/189 |
| 3,255,927 | A | * | 6/1966 | Ruppert, Jr. et al. | 222/143 |
| 3,528,652 | A | * | 9/1970 | Tarbox | 482/105 |
| 4,420,275 | A | * | 12/1983 | Ruser | 405/217 |
| 4,685,890 | A | | 8/1987 | Edwards | |
| 4,707,873 | A | * | 11/1987 | A-Yan | 5/502 |
| 4,846,464 | A | * | 7/1989 | Jorno | 482/105 |

(Continued)

FOREIGN PATENT DOCUMENTS

CA 624701 A * 8/1961

OTHER PUBLICATIONS

Elmer's Deluxe Therapeutic Weights, BollingerHealthcare, catalog BHC-001-5/95-20K-SWC, p. 18, 1995.*

(Continued)

*Primary Examiner* — Loan Thanh
*Assistant Examiner* — Nyca T Nguyen
(74) *Attorney, Agent, or Firm* — Baker Botts L.L.P.

(57) ABSTRACT

An article (101) is provided which may include a body (103) having an interior volume (113), and a collapsible inlet (105) which is in open communication with said interior volume and which is movable from a first position in which it extends from said body, to a second position in which it extends into said internal volume.

25 Claims, 26 Drawing Sheets

(56) References Cited

U.S. PATENT DOCUMENTS

| | | | | | |
|---|---|---|---|---|---|
| 4,952,190 | A * | 8/1990 | Tarnoff et al. | 446/267 |
| 5,332,185 | A * | 7/1994 | Walker, III | 248/346.2 |
| 5,476,067 | A * | 12/1995 | Queen et al. | 119/168 |
| 5,704,883 | A * | 1/1998 | Eckmann | 482/105 |
| 5,718,655 | A * | 2/1998 | Phillips | 482/49 |
| 5,848,946 | A * | 12/1998 | Stillinger | 473/594 |
| 6,099,441 | A | 8/2000 | Bonnet | |
| 6,149,555 | A * | 11/2000 | Kinback | 482/93 |
| 6,149,557 | A * | 11/2000 | Williams et al. | 482/105 |
| 6,186,701 | B1 * | 2/2001 | Kempers | 405/19 |
| 6,224,517 | B1 * | 5/2001 | Dereszynski | 482/93 |
| 6,261,211 | B1 * | 7/2001 | Suarez et al. | 482/107 |
| 6,969,195 | B2 * | 11/2005 | Ferranda | 383/44 |
| 7,891,914 | B2 * | 2/2011 | Smallwood et al. | 405/302.6 |
| 2004/0072660 | A1 * | 4/2004 | Mercuri et al. | 482/105 |
| 2006/0063653 | A1 | 3/2006 | Wickens et al. | |
| 2011/0287904 | A1 * | 11/2011 | Morris | 482/93 |

OTHER PUBLICATIONS

Corresponding PCT application Search Report dated Sep. 22, 2009; 9 pages.

* cited by examiner

WEIGHTED ARTICLE WITH FILL SPOUT

CROSS REFERENCE TO RELATED APPLICATION

This application claims the benefit of priority from U.S. Provisional Application No. 61/137,172 filed on Jul. 28, 2008, having the same title, and having the same inventors, and which is incorporated herein by reference in its entirety.

FIELD OF THE DISCLOSURE

The present disclosure relates generally to weighted articles such as sand bags, and more particularly to weighted and/or sealed articles which are equipped with a fill spout.

BACKGROUND OF THE DISCLOSURE

A variety of sand bags are currently known to the art. Sand bags have achieved prolific usage as rapidly deployed flood barriers, but are also commonly employed in other applications, such as highway construction and military applications. Sand bags have also found usage as exercise devices. For example, firemen commonly perform training exercises with sand bags, due to the ability of sand bags to replicate the dead weight of an unconscious person.

SUMMARY OF THE DISCLOSURE

In one aspect, an article is provided which comprises a fillable body having an interior volume, and a collapsible inlet which extends into said internal volume.

In another aspect, an article is provided which comprises (a) a body having an aperture in a wall thereof; (b) an inlet having a first end which is attached to said wall in the vicinity of said aperture, and a second end which is disposed within said body; and (c) a fill material disposed within said body, said fill material being selected from the group consisting of granular materials and liquids; wherein said inlet has a longitudinal axis and is collapsible in a direction perpendicular to said longitudinal axis when said body is filled with said fill material.

In a further aspect, an article is provided which comprises (a) a body having an interior volume; and (b) a collapsible inlet which is in open communication with said interior volume and which is movable from a first position in which it extends from said body, to a second position in which it extends into said internal volume.

In still another aspect, a method for creating an article is provided. The method comprises (a) providing a body having an aperture in a wall thereof, said body being equipped with an inlet which extends into said body, said inlet having a first or proximal end which is attached to said wall in the vicinity of said aperture; (b) inserting a funnel into said inlet; and (c) filling said body, by way of said funnel, with a fill material selected from the group consisting of granular materials, liquids and/or gases.

In yet another aspect, a method for creating an article is provided. In accordance with the method, a body is provided which has an interior volume and which is equipped with a collapsible, invertible inlet extending from said body which is in open communication with said interior volume. A fill is introduced into said internal volume by way of said inlet, after which said inlet is inverted such that said inlet extends into said internal volume.

DETAILED DESCRIPTION

Figure 1:
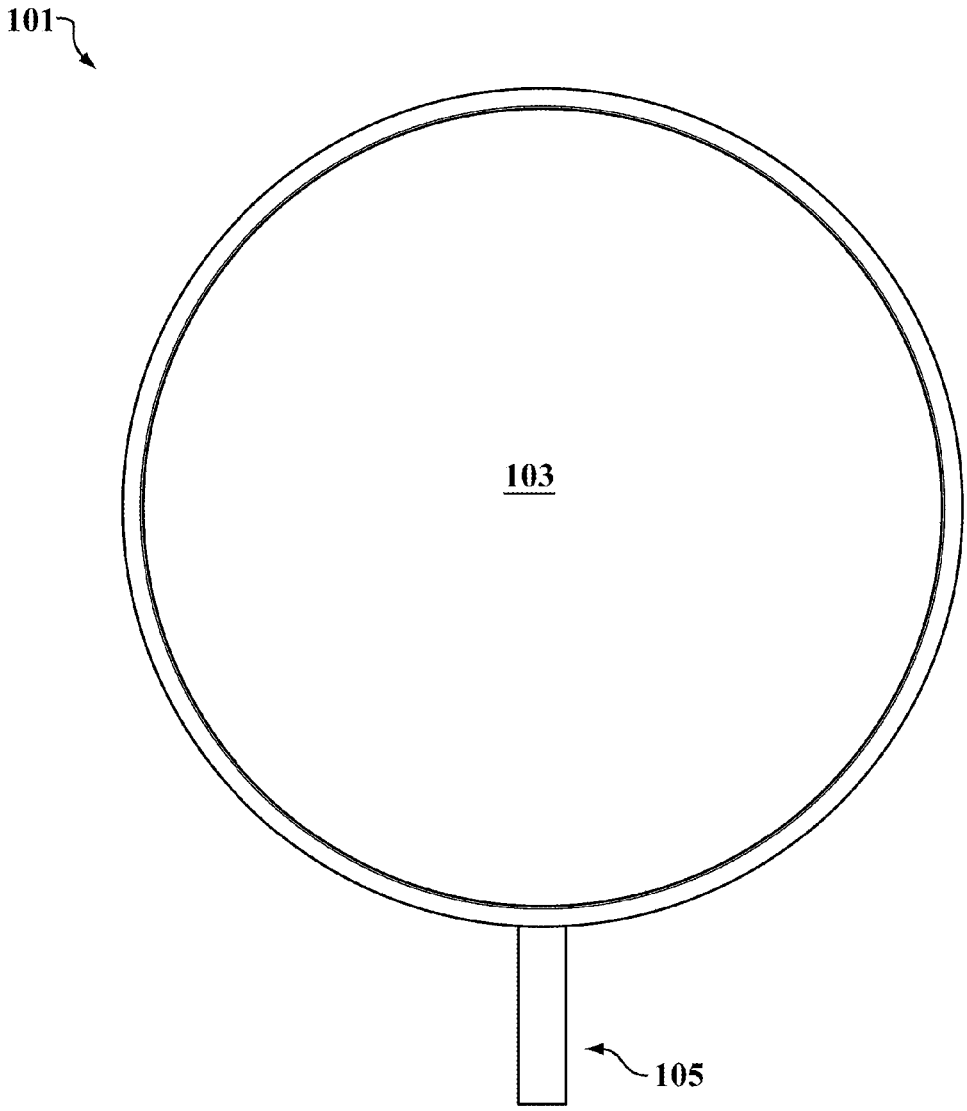
FIG. 1 is a top view of a first particular, non-limiting embodiment of a weighted article in accordance with the teachings herein.
Figure 2:
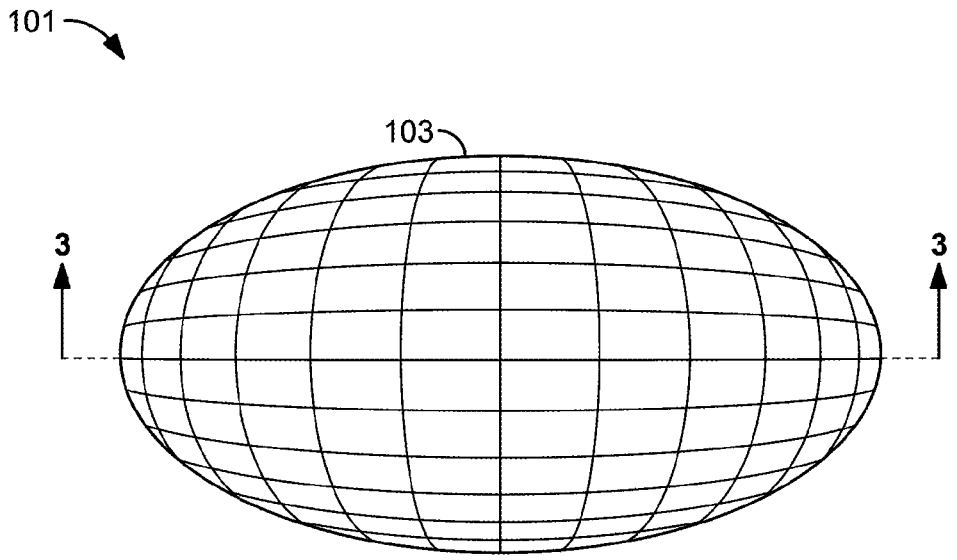
FIG. 2 is a side view of the embodiment of FIG. 1.

While sandbags of the type currently available in the art have many advantages, they also suffer from a number of infirmities. In particular, many sandbags are basically sacks which are open on one end, and which are tied or folded shut after they are filled. This may be accomplished, for example, by forming a knot in the fabric of the sandbag, by tying the bag shut with twine, or by simply folding the open end of the sand bag underneath the bag after it has been filled.

However, it is challenging to create a secure closure for such sand bags in a time efficient manner using the aforementioned approaches. This problem is exacerbated by the fact that sand readily absorbs moisture during use and can thus exert considerable pressure on the closure. Consequently, it is common for sandbags to leak sand or to rupture along a seam, or for the closure to become undone during use. This is particularly problematic if the sandbags are intended for use as exercise devices.

It has now been found that the aforementioned problems may be overcome through the provision of a sandbag or other weighted article which comprises a fillable body having an interior volume, and having a collapsible or flexible inlet which is invertible and which can be extended into the interior of the body after a fill material has been added to the internal volume. Preferably, the inlet is repositionable from a first position in which it protrudes from the body, to a second position in which it extends into the interior of the body. This may be accomplished, for example, by inverting the inlet (that is, by turning the inlet inside out).

The interior volume of the weighted article is preferably filled with sand or another desired fill material while the inlet is in the first position (possibly with the use of a funnel), after which the inlet is moved to the second position. When the inlet is in the second position (and assuming that a sufficient amount of fill material has been added to the interior volume of the body), the weight of the fill material collapses the inlet and effectively seals it off, thereby securely sealing the fill material within the weighted article without the need for knots, twine, or other such accoutrements.

If it is desired at any time to remove some or all of the fill material from the weighted article, a funnel or a rigid tube of suitable diameter may be used to maintain the collapsible inlet in an open position while the desired amount of fill material is removed. Preferably, this procedure is conducted while the inlet is in the first position.

The devices and methodologies disclosed herein may be further understood with respect to FIGS. 1-4, which illustrate a first particular, non-limiting embodiment of a weighted article in accordance with the teachings herein. The weighted article in this particular embodiment is a sandbag having a generally ellipsoidal shape, although it will be appreciated that a wide variety of other weighted articles of various other shapes and dimensions, and which are filled with various other fill materials, may be produced in accordance with the teachings herein.

Figure 3:
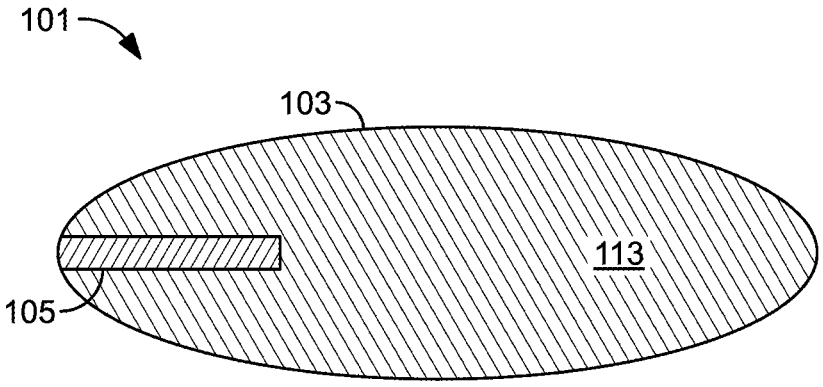
FIG. 3 is a cross-sectional view of the embodiment of FIG. 1 taken along LINE 3-3.
Figure 4:
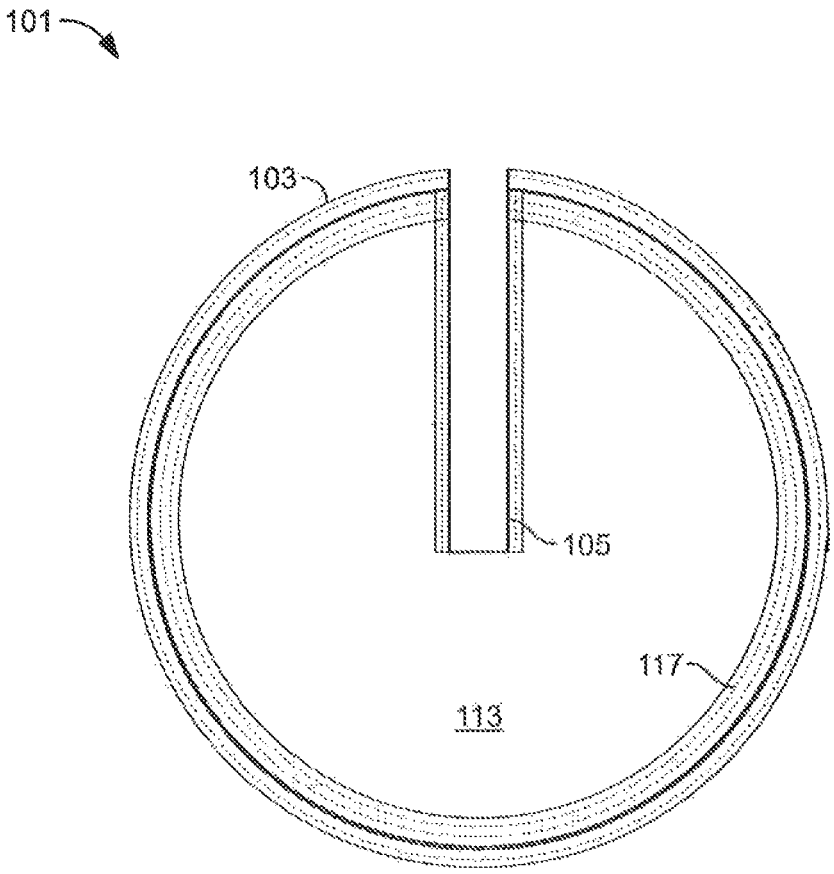
FIG. 4 is a cross-sectional view of the embodiment of FIG. 1 which is similar to FIG. 3, but which shows details of the stitching and the inlet.
Figure 5:
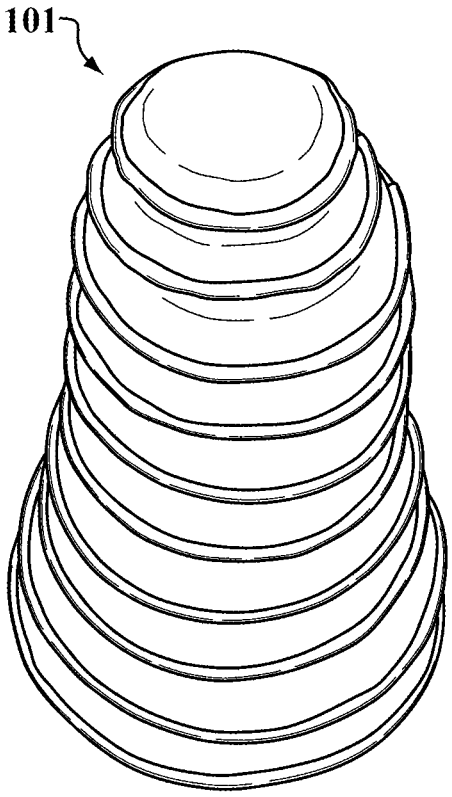
FIG. 5 is a perspective view showing a collection of weighted articles of various weights and sizes and fashioned in the likeness of the device depicted in FIG. 1.
Figure 6:
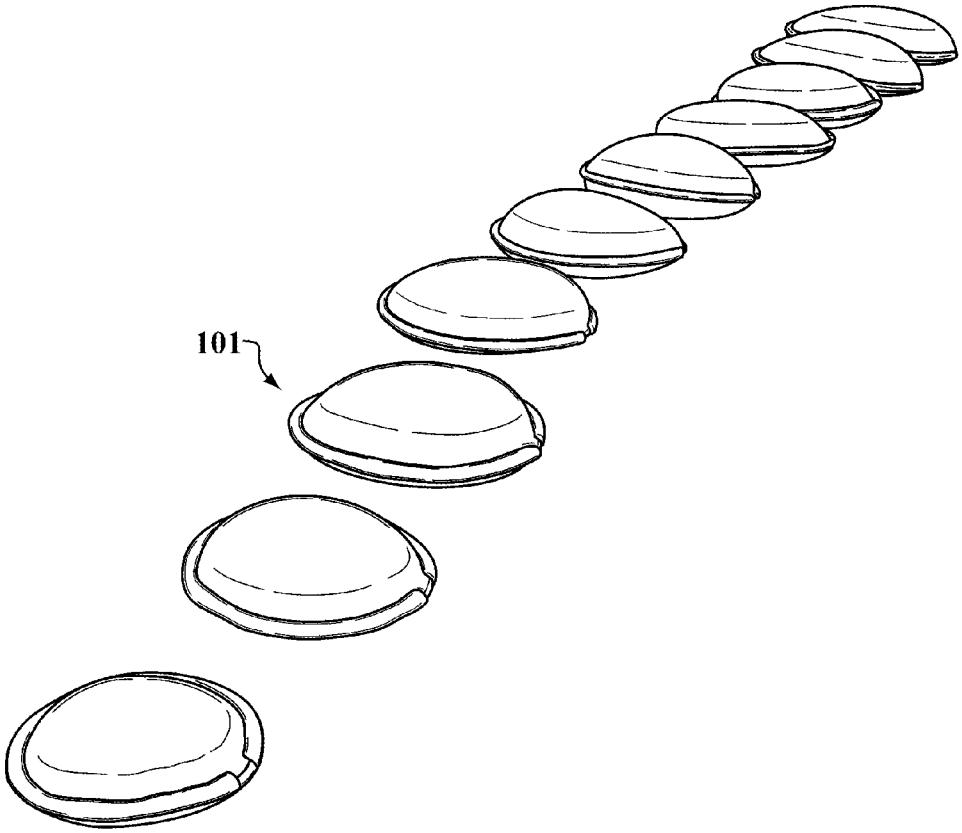
FIG. 6 is a perspective view showing a collection of weighted articles of various weights and sizes and fashioned in the likeness of the device depicted in FIG. 1.
Figure 7:
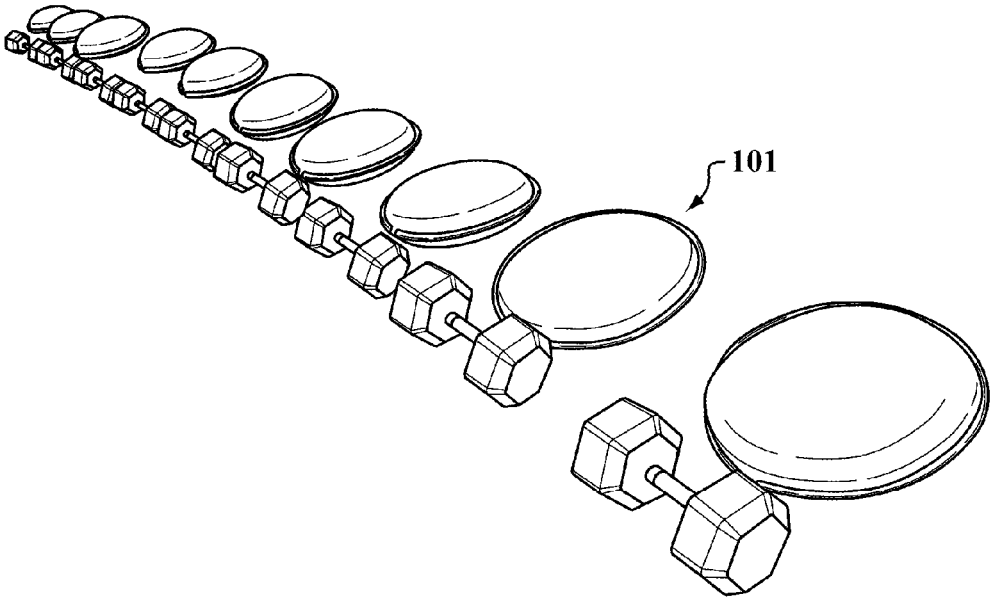
FIG. 7 is a perspective view showing a collection of weighted articles of various weights and sizes and fashioned in the likeness of the device depicted in FIG. 1; the weighted articles are shown next to barbells of the same weight for comparison.
Figure 8:
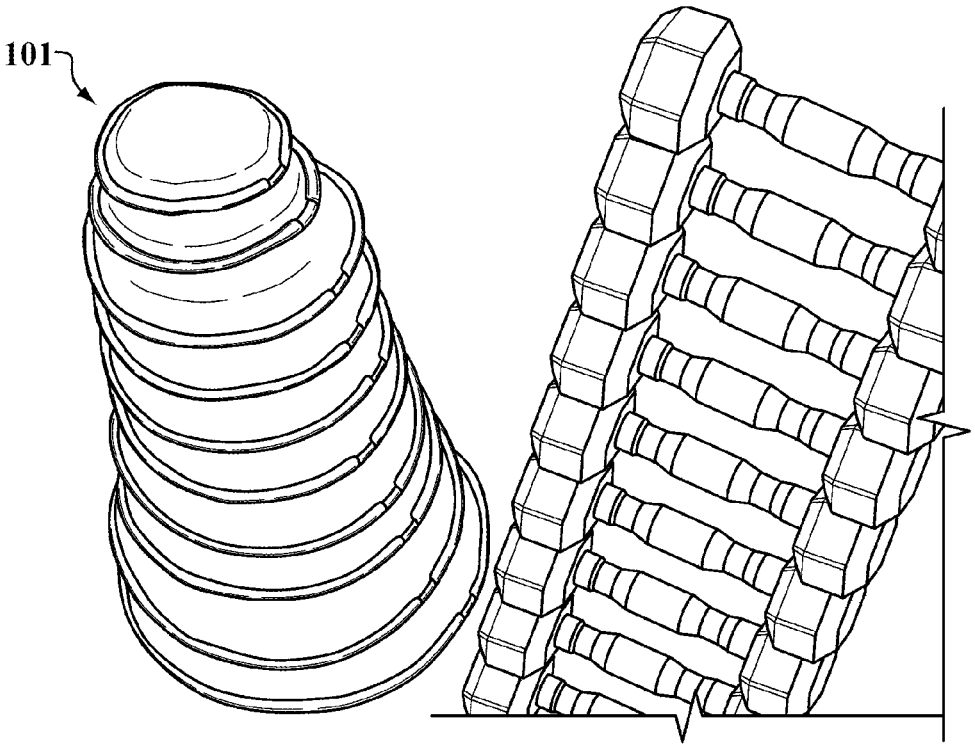
FIG. 8 is a perspective view showing a collection of weighted articles of various weights and sizes and fashioned in the likeness of the device depicted in FIG. 1; the weighted articles are shown next to barbells of the same weight for comparison.

The weighted device 101 depicted comprises a body 103 which encloses an interior volume 113 (see FIG. 3). The interior volume 113 of the device is accessible by way of a collapsible inlet 105. Preferably, as noted above, the inlet 105 is repositionable or movable from a first position in which it protrudes from the body 103 (see FIG. 15) to a second position in which it extends into the interior of the body 103 (see FIGS. 3 and 14). The body 103 is preferably filled with sand or another desired fill material while the inlet 105 is in the first position. A funnel 121 may be used for this purpose, as shown in FIG. 16. After the device is filled to the desired extent, the inlet 105 is moved to the second position, where the weight of the fill collapses the inlet 105. This effectively seals off the interior volume 113 of the body 103, thereby securely containing the fill material therein without the need for knots, twine, or other such accoutrements. If it is desired to remove some or all of the fill material from the body 103, a funnel or a rigid tube of suitable diameter may be used to maintain the collapsible inlet 105 in an open position while the fill material is being removed.

The collapsible inlet 105 may comprise various materials including, for example, nylon, rubber, various fabrics, or other suitable materials which are sufficiently deformable such that the pressure exerted by the fill material will effectively seal the inlet 105 off when the interior volume 113 is at least partially filled.

In use, a funnel, tube or other suitable device is inserted into the inlet 105, preferably when the inlet 105 is in the first position (see above), and is utilized to introduce the fill material. After the interior space 113 has been filled to a suitable extent, the funnel is removed, and the inlet 105 is pushed into the interior of the body 103 (that is, the inlet 105 is moved to the second position). This may be accomplished, for example, through the use of a rod, a tube, the end of the funnel used to fill the device, or a finger. Preferably, the inlet is fully extended within the body when it is in the second position, though in some embodiments it may be preferable for the inlet to be only partially extended within the body or to be folded or otherwise placed in a convoluted orientation when it is in the second position. In the second position, the inlet 105 collapses under the weight of the fill material, thereby effectively sealing the interior space 113.

Figure 9:
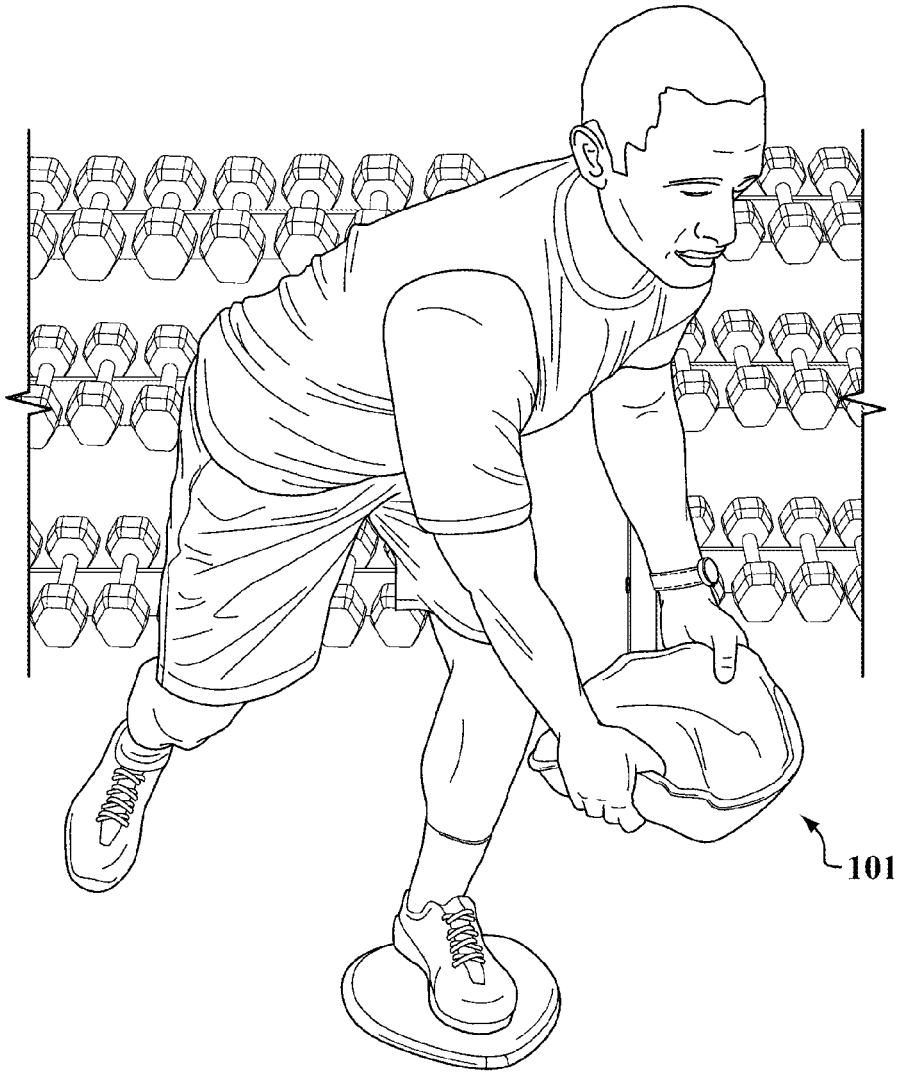
FIG. 9 is a perspective view showing the use of a weighted article of the type depicted in FIG. 1 in an exercise session.
Figure 10:
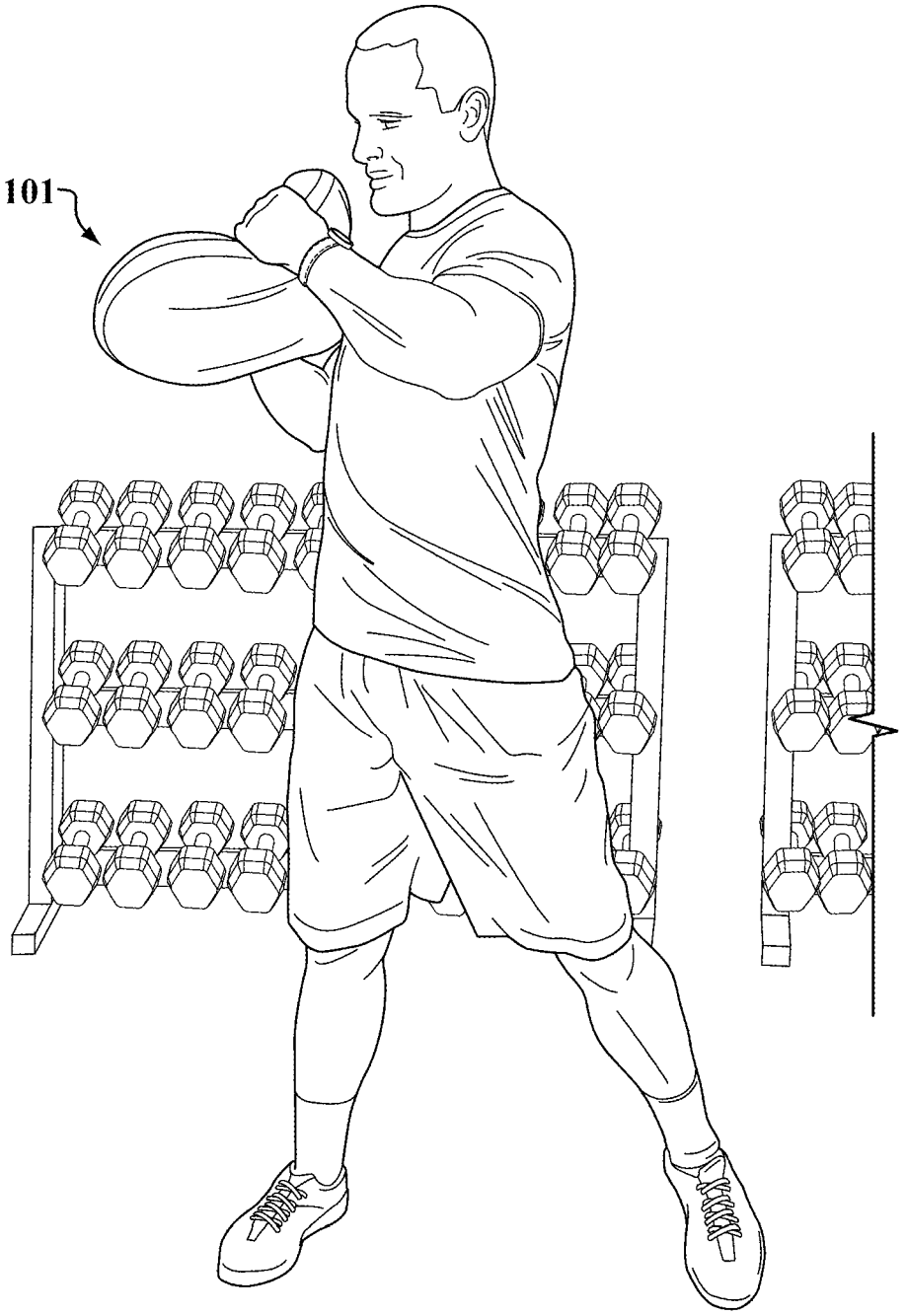
FIG. 10 is a perspective view showing the use of a weighted article of the type depicted in FIG. 1 in an exercise session.
Figure 11:
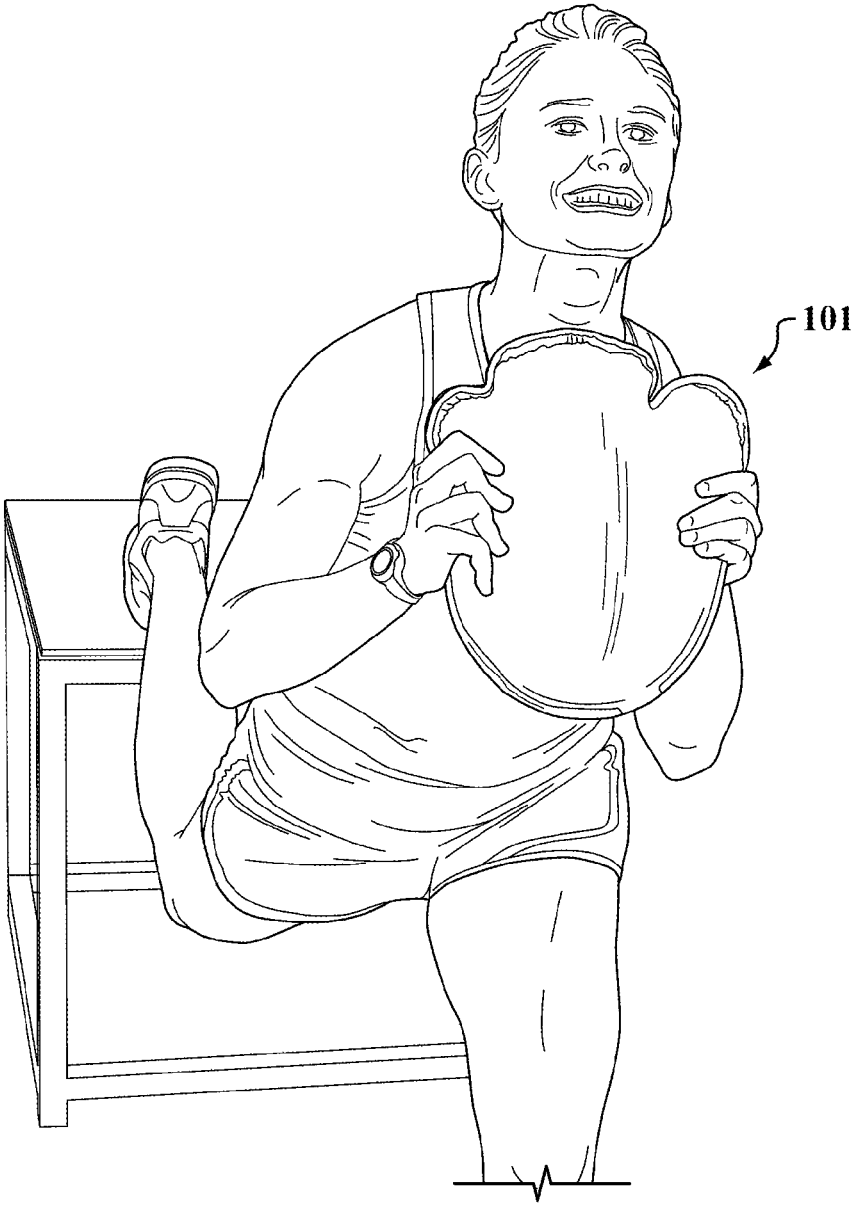
FIG. 11 is a perspective view showing the use of a weighted article of the type depicted in FIG. 1 in an exercise session.

FIGS. 9-11 illustrate some of the many possible ways in which the devices disclosed herein may be utilized in an exercise regimen. As seen in these figures, the weighted articles 101 disclosed herein are particularly well suited for use in a variety of floor exercises aimed at strengthening the arms, legs, torso, and hands, while also improving balance and agility.

Because the devices described herein may be constructed in various sizes and weights, they may be used in many of the same exercises that conventional dumbbells, barbells and other such devices are commonly utilized in, in addition to a variety of exercises for which the foregoing devices are not suitable. In such applications, the deformability of these devices offers unique advantages. For example, because these devices can be made to conform to the user's hands, they provide a firm grip to the user while also fully engaging the muscles of the hands and fingers of the user during a workout. The degree of conformity may be adjusted within a certain range by adjusting the extent to which the device is filled, through selection of appropriate materials for the body of the device, and/or through the appropriate selection of fill materials. Typically, reducing the amount of fill will increase the conformity of the device within a certain range.

Figure 12:
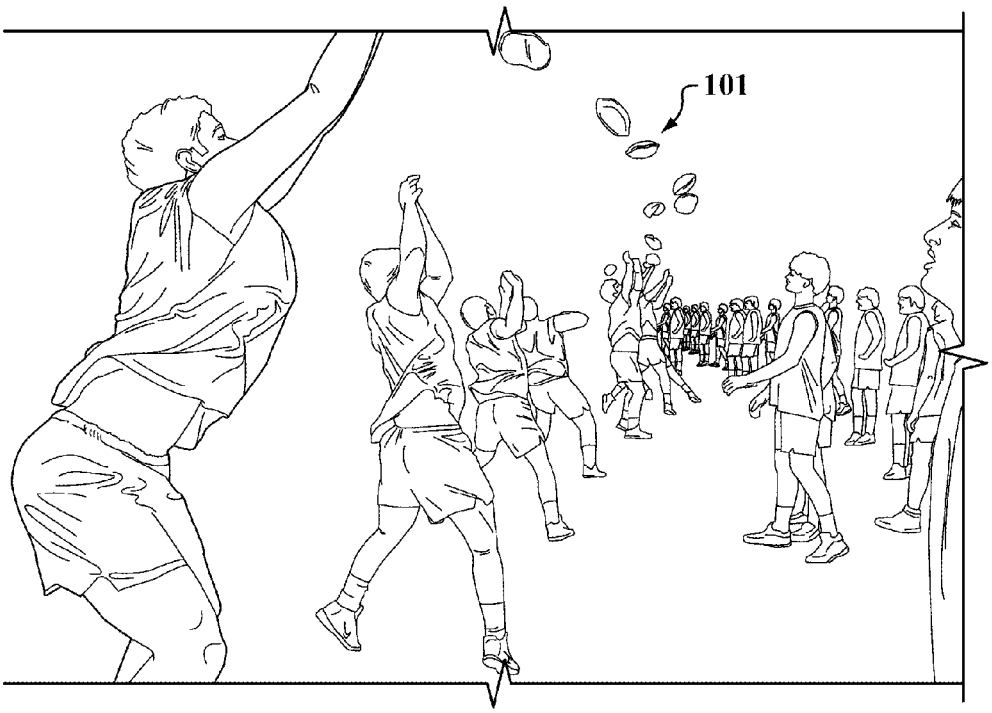
FIG. 12 is a perspective view showing the use of a weighted article of the type depicted in FIG. 1 in an exercise session.

In addition, because the exterior surface of these devices may comprise neoprene or other soft, elastomeric materials, incidental contact with these surfaces during a workout are unlikely to harm the user. This feature makes these devices especially suitable for use by children and the elderly. Moreover, this feature, in combination with the durable structures these devices may be fabricated in, enables a variety of exercises in which the devices may be thrown or caught. Such a use, which is illustrated in FIG. 12, is typically not feasible with conventional weights or dumbbells.

FIGS. 4 and 13-16 illustrate the details of a preferred embodiment of the stitching scheme which may be utilized in the weighted article 101. As seen therein, in the particular embodiment depicted, the weighted article 101 comprises opposing walls of material which enclose an internal volume to which a desired fill material may be added. The opposing walls of material are preferably double-stitched together along a seam 117. Preferably, the seam 117 is constructed so that it faces outward from the device, since this is found to improve the impact resistance of the device and minimizes the likelihood that the fabric will tear along the seam 117.

Figure 13:
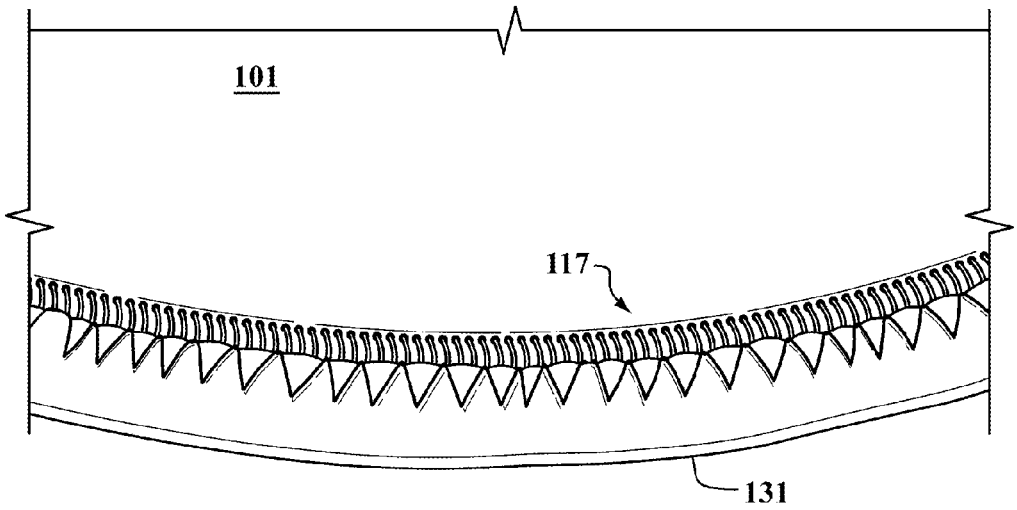
FIG. 13 is a perspective view showing some of the details of the seam of a weighted article of the type depicted in FIG. 1.
Figure 14:
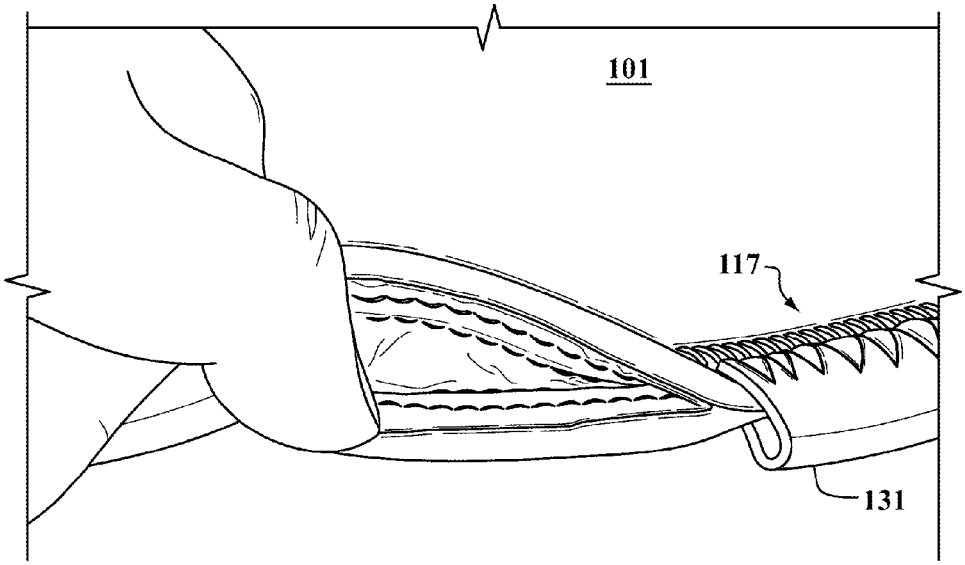
FIG. 14 is a perspective view showing some of the details of the inlet of a weighted article of the type depicted in FIG. 1.

As seen in FIGS. 13-14, a portion of capping material 131 is then sewn over the exposed seam 117, preferably with cross-stitching. The capping material 131 is preferably rolled under along one edge as shown in FIG. 14 to impart a rounded edge to the seam. The capping material 131 may be the same as, or different from, the material of the body of the device, and provides a smooth, more aesthetically pleasing edge to the device, while also imparting additional mechanical integrity to the seam 117.

As indicated in FIGS. 5-8, the capping material 131 may be color-coded to indicate the weight of the device. TABLE 1 below provides one specific, non-limiting example of a possible color-coding scheme which may be used to indicate the weight of the device, although it will be appreciated that various other color schemes or patterns may be used to a similar end.

TABLE 1

Possible Color Code for Weights

| Color | Weight (in lbs.) |
|---|---|
| Red | 2 |
| Yellow | 4 |
| Dark Orange | 6 |
| Light orange | 8 |
| Dark Green | 10 |
| Medium blue | 12 |
| Dark blue | 15 |
| Purple | 20 |
| Black | 25 |
| Light green | 30 |
| White | 40 |
| Tan | 50 |

Figure 15:
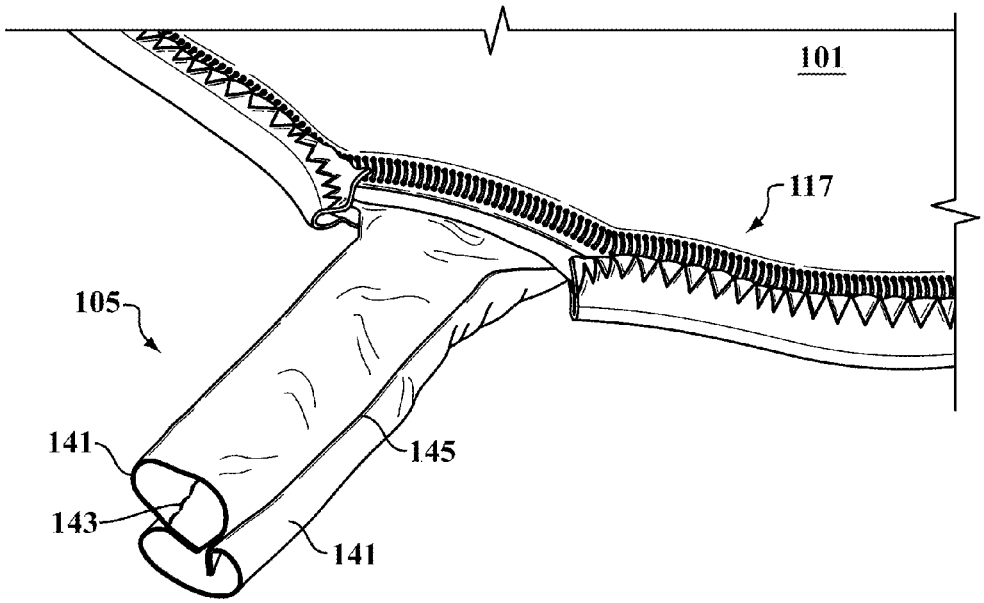
FIG. 15 is a perspective view showing some of the details of the inlet of a weighted article of the type depicted in FIG. 1.
Figure 16:
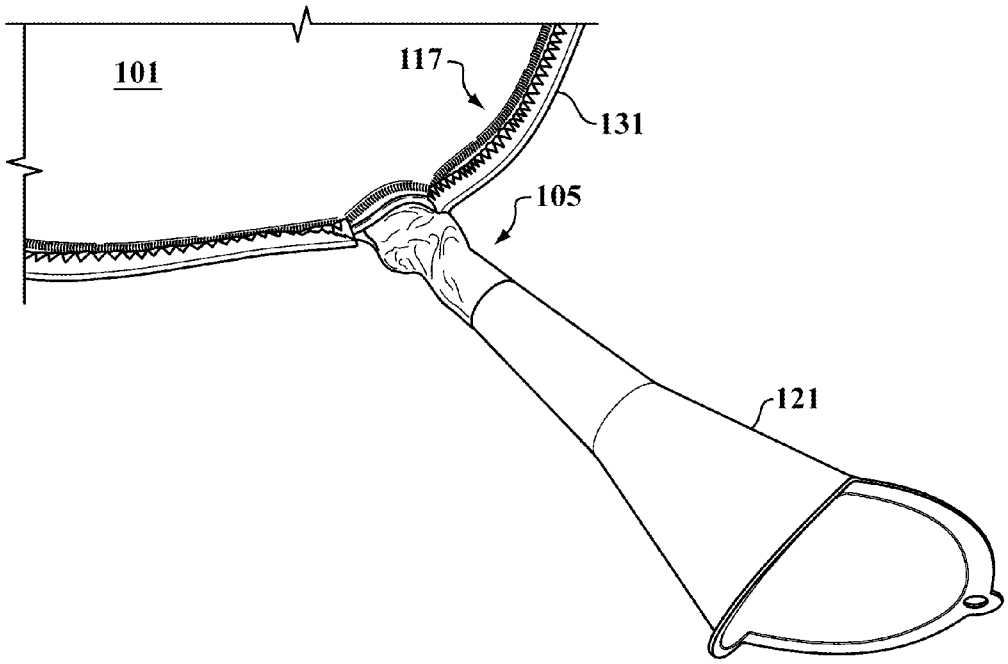
FIG. 16 is a perspective view showing the use of a funnel in conjunction with the inlet to fill a weighted article of the type depicted in FIG. 1.
Figure 17:
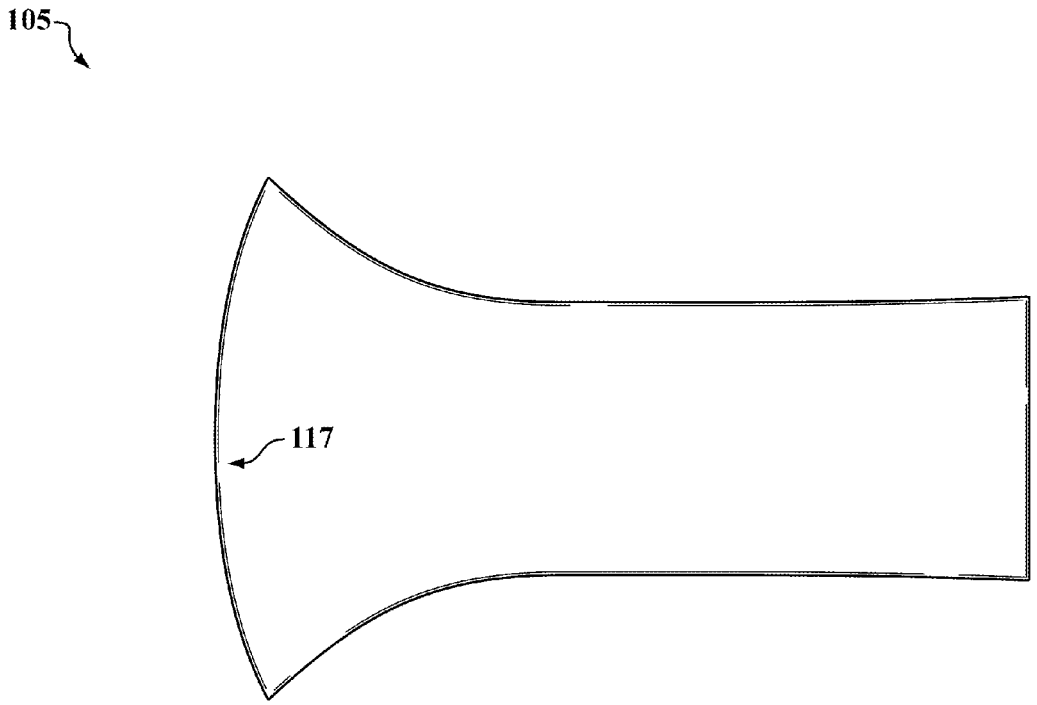
FIG. 17 is an illustration of an inlet for use in a weighted article of the type depicted in FIG. 1.
Figure 18:
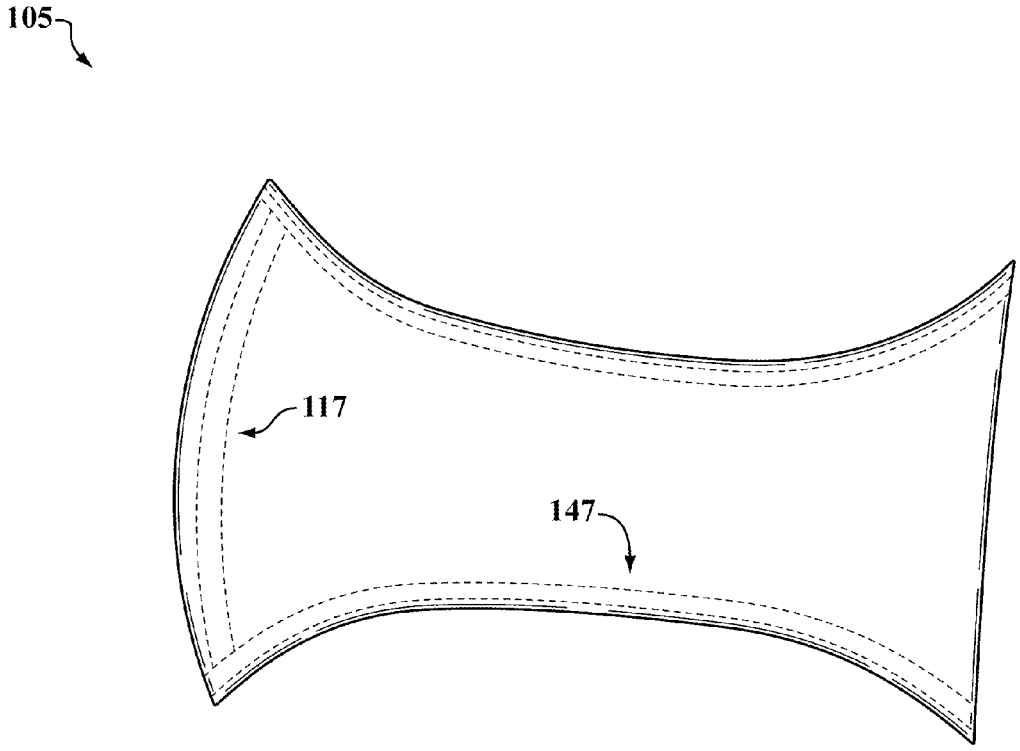
FIG. 18 is an illustration of an inlet for use in a weighted article of the type depicted in FIG. 1.
Figure 19:
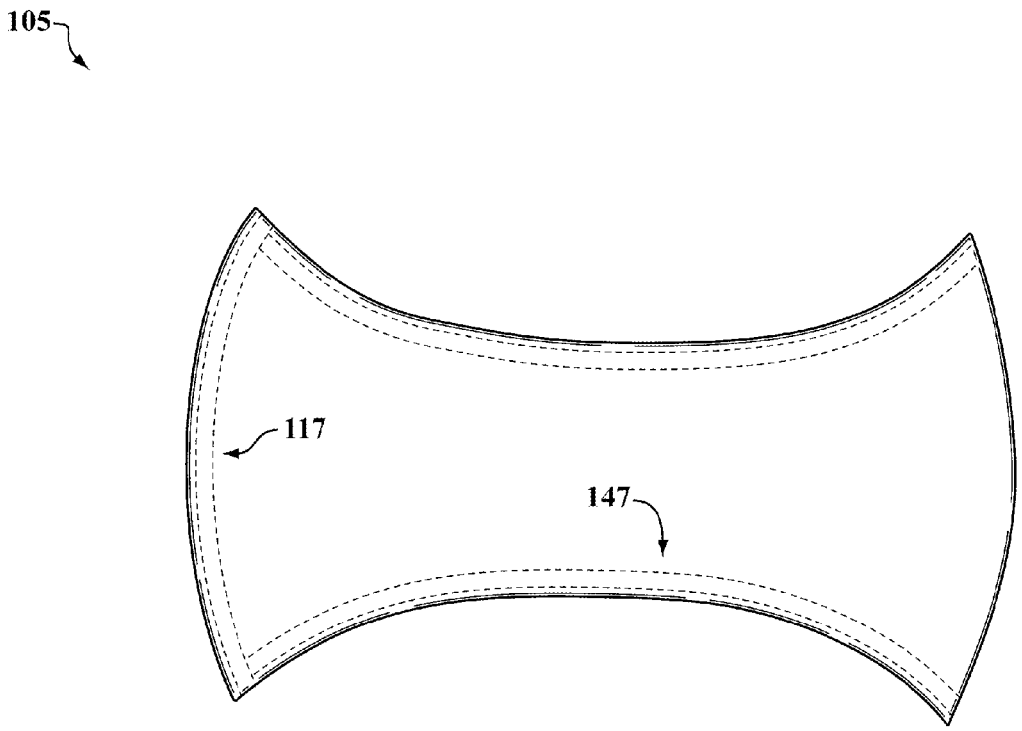
FIG. 19 is an illustration of an inlet for use in a weighted article of the type depicted in FIG. 1.
Figure 20:
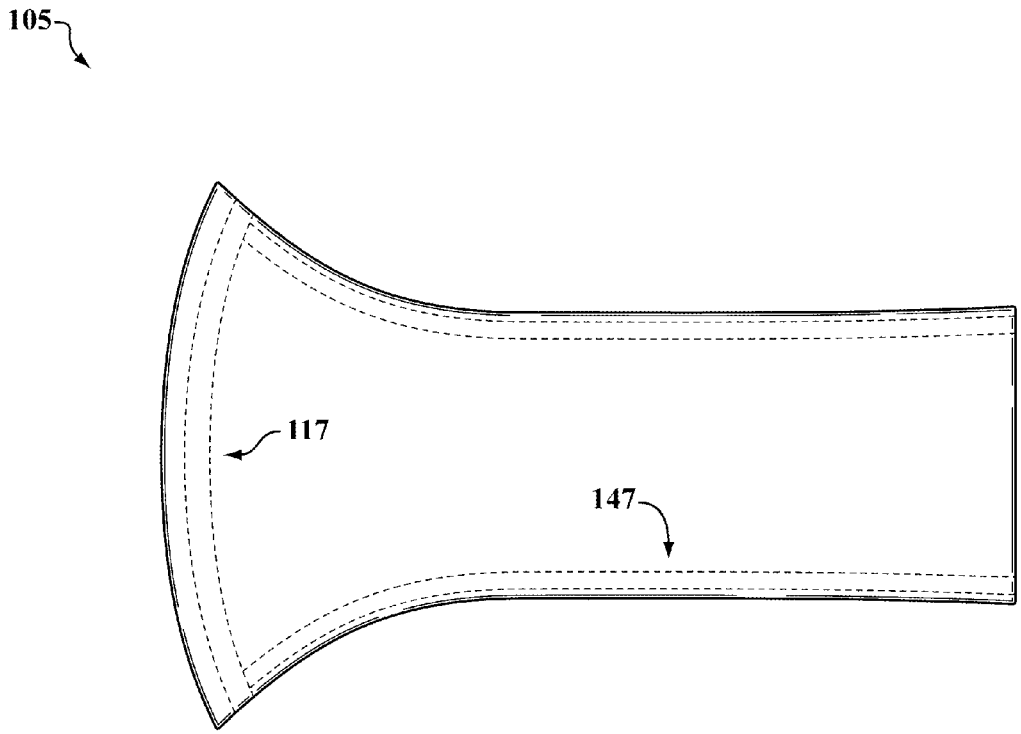
FIG. 20 is an illustration of an inlet for use in a weighted article of the type depicted in FIG. 1.
Figure 21:
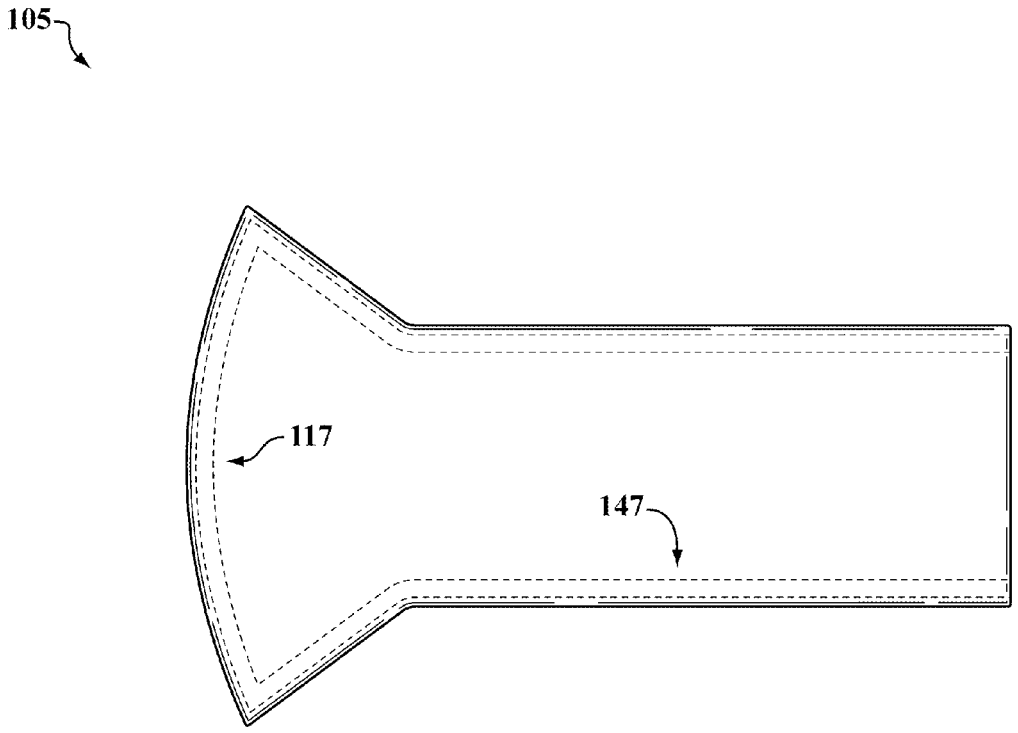
FIG. 21 is an illustration of an inlet for use in a weighted article of the type depicted in FIG. 1.

FIGS. 14-15 illustrate further features of the inlet 105 of the weighted device 101 and the preferred stitching which is used in conjunction with the inlet 105. Various possible geometries for the inlet 105 are depicted in FIGS. 17-26, along with some possible stitching schemes that may be employed in conjunction with these geometries. The geometries depicted show the inlet 105 as it appears in the second position (when it extends into the internal volume of the device 101).

Preferably, the inlets 105 utilized in the devices 101 described herein are formed from two identically or complementary shaped portions 141 of material which are stitched, glued or laminated together along first 143 and second 145 opposing edges, although one skilled in the art will appreciate that unitary constructions may also be employed for the inlet. More preferably, the two portions 141 of material are double stitched together along their adjoining edges 143, 145. It is preferred that the seam 147 formed in this manner is facing outward so that, when the inlet 105 is in the second position (see FIG. 14), the opposing surfaces of the inlet 105 will tend to lie flush together, thus preventing the egress of fill material through the inlet 105. By contrast, when the inlet 105 is inverted (as when it is in the first position in which it extends from the body 103 of the device 101; see FIG. 15), the inverted seam 147 will cause the inlet 105 to pucker open slightly, thus facilitating the addition of fill to the device 101.

Referring again to FIG. 14, the proximal portion of each opposing wall of the inlet 105 is preferably double-stitched to the adjacent portion of the body material. This double stitching is preferably a continuation of the stitching used to adhere the opposing walls of the body 103 together, since such a construction minimizes the stress applied to the inlet 105 along the region of attachment.

Figure 22:
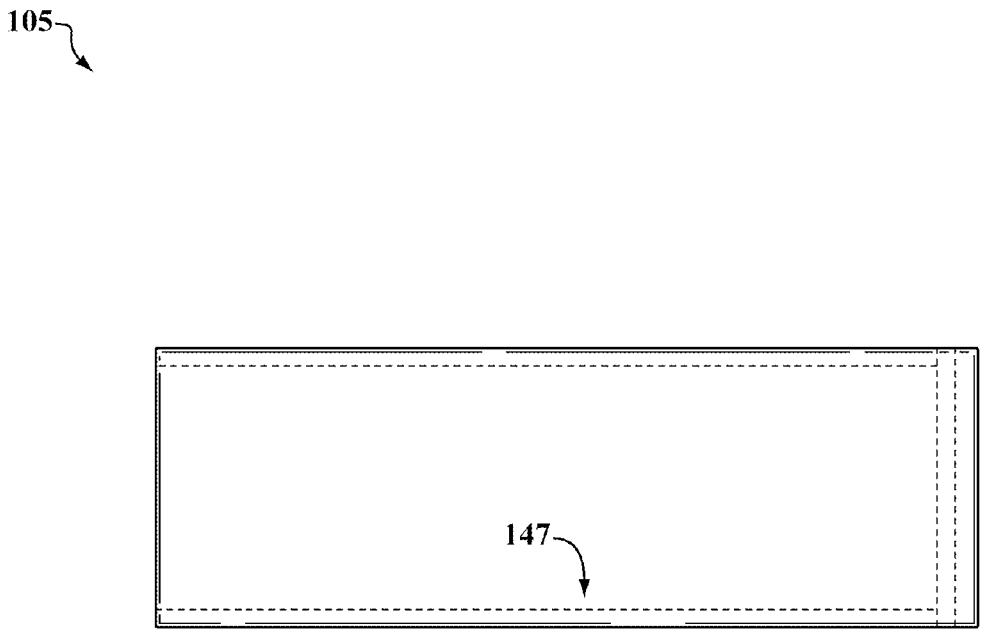
FIG. 22 is an illustration of an inlet for use in a weighted article of the type depicted in FIG. 1.
Figure 23:
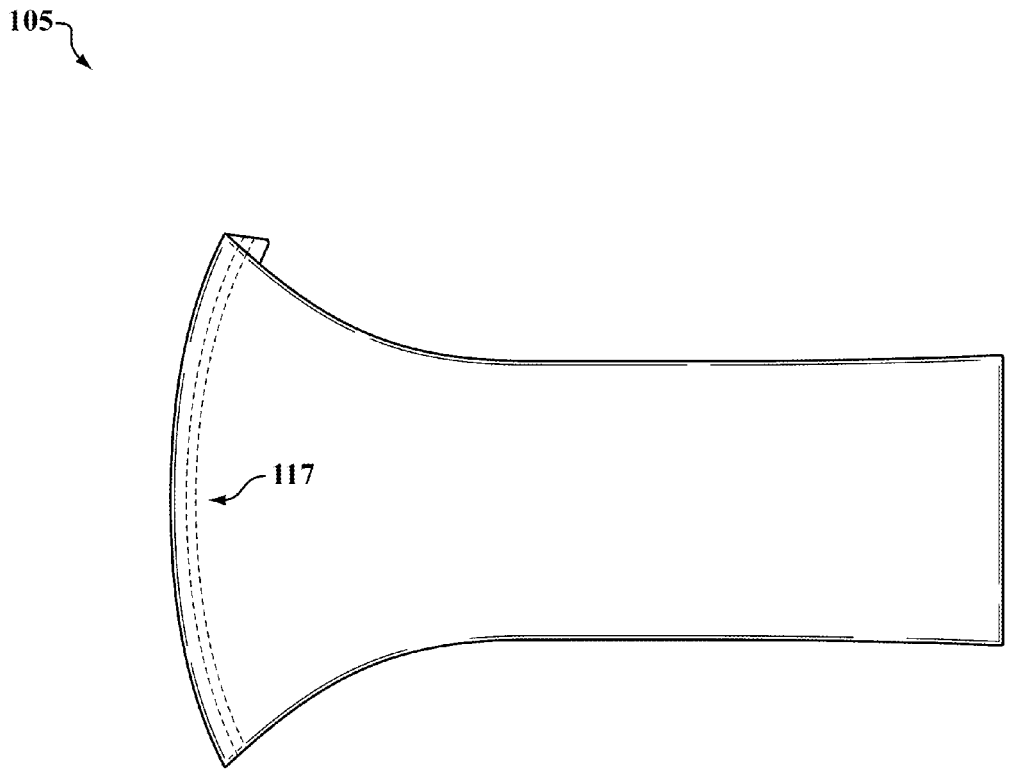
FIG. 23 is an illustration of an inlet for use in a weighted article of the type depicted in FIG. 1.
Figure 24:
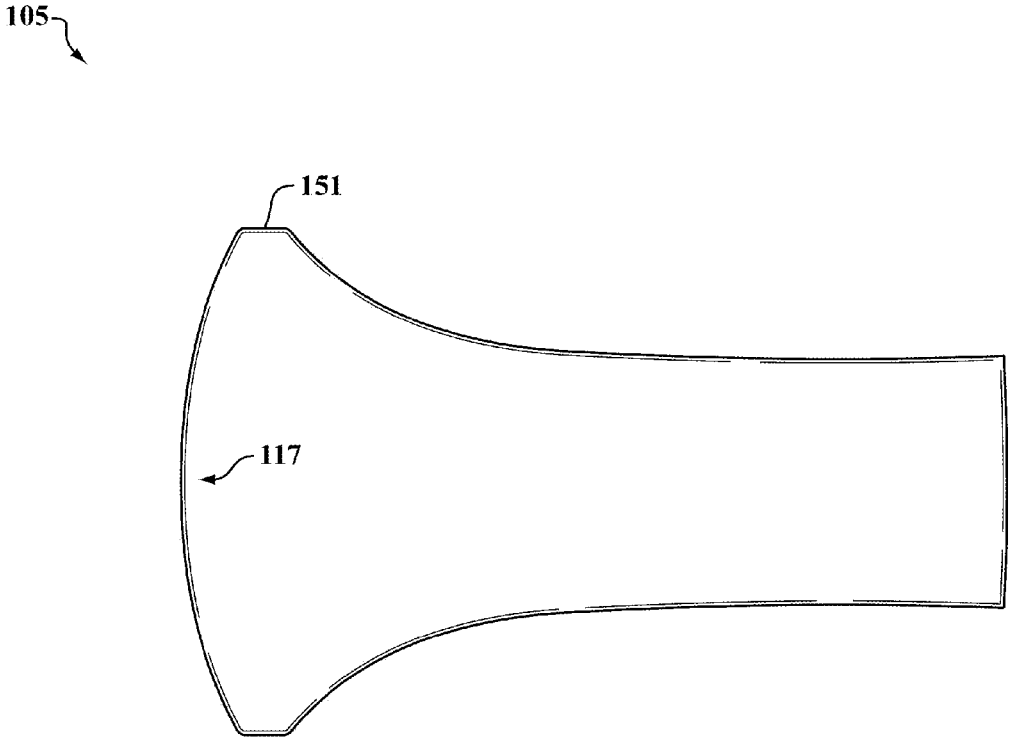
FIG. 24 is an illustration of an inlet for use in a weighted article of the type depicted in FIG. 1.

Preferably, the proximal portion of the inlet 105 is rounded to match the curvature of the seam 117 as shown in FIGS. 17-21 and 23-26, though in some embodiments, such as the embodiment depicted in FIG. 22, the proximal portion of the inlet 105 may be flat instead. Of course, it will be appreciated that the preferred geometry of the inlet 105 will be determined in part by the geometry of the body 103. For example, if the body 103 is polyhedral in shape, then an inlet 105 having a flattened edge, such as the embodiment depicted in FIG. 22, may be preferred.

It is also preferred that the proximal portion of the inlet 105 is tapered or flared as shown in FIGS. 17-21 and 23-26. This increases the surface area available for stitching, thus improving the integrity of the seam between the inlet and the body 103. On the other hand, the narrower neck of such an inlet hinders the escape of fill from the interior volume of the body. In some embodiments, the distal portion of the inlet 105 may also be tapered or flared. Such an embodiment may be advantageous in some applications in that it facilitates the insertion of a tube or funnel into the inlet 105 when it is in the first position.

Figure 25:
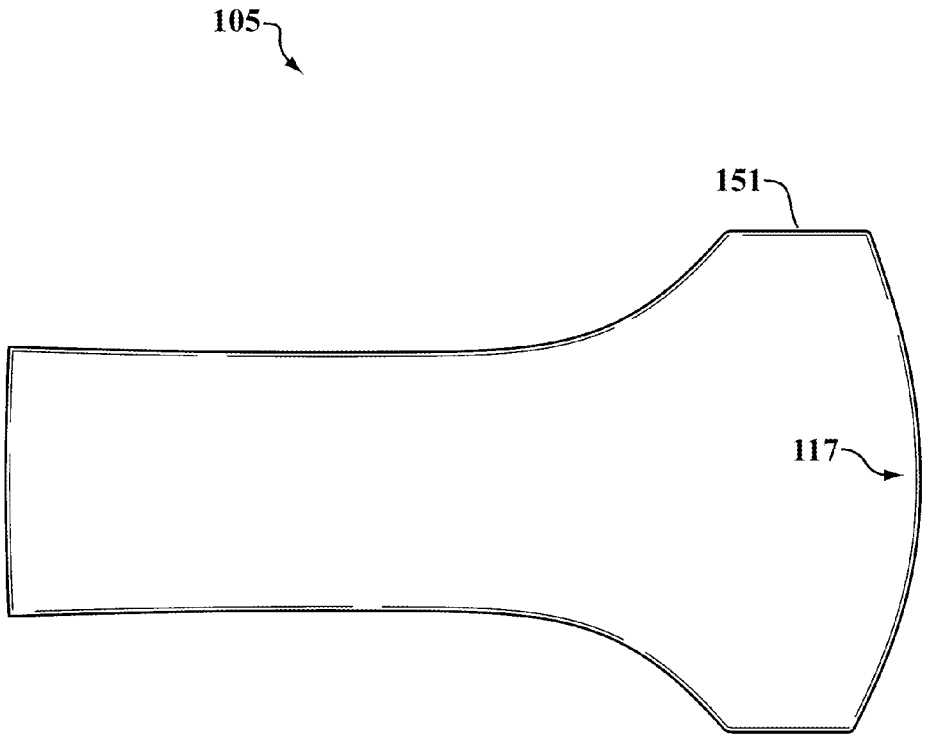
FIG. 25 is an illustration of an inlet for use in a weighted article of the type depicted in FIG. 1.
Figure 26:
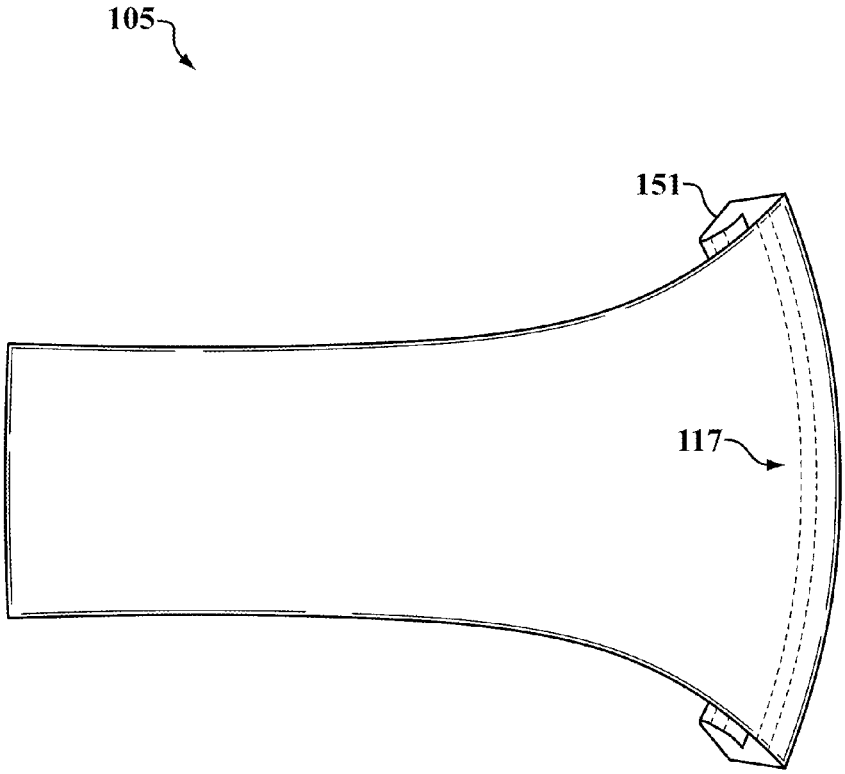
FIG. 26 is an illustration of an inlet for use in a weighted article of the type depicted in FIG. 1.

As indicated in FIGS. 25-26, in some embodiments, the proximal portion of the inlet may be provided with an extra portion 151 of material which may be folded over prior to stitching the proximal portion of the inlet 105 to the adjacent portion of the body 103. In some applications, such an approach may improve the durability of the portion of the seam 117 extending across the inlet 105. Though not preferred, in some embodiments, this portion of the inlet 105 may be folded over the adjacent portion of the exterior of the body 103 prior to being sewn or otherwise attached in place.

While the foregoing examples illustrate the production of one particular, non-limiting embodiment of a weighted article made in accordance with the teachings herein, it will be appreciated that various other types of weighted articles of various other geometric shapes and sizes may be made in accordance with the teachings herein. For example, in addition to being ellipsoidal, the weighted article may be essentially polyhedral (including, without limitation, tetrahedral, pentahedral or hexahedral), prismatic, torroidal, spherical, or irregular in shape.

Similarly, while the foregoing example illustrates the production of a sandbag, it will be appreciated that various other weighted articles may be formed in accordance with the teachings herein. These include, for example, various types of anchors, exercise weights, and the like.

Moreover, while sand is a preferred fill material, it will be appreciated that various other fill materials may also be utilized in the devices described herein depending, in part, on the intended use of the device. For example, metals (including, but not limited to, iron and lead), metal shot, metal shavings, various viscous materials (including silica gel), water, pebbles, beans, seeds, gravel, charcoal, and various other liquids and granular materials (or combinations thereof) may be used as fill materials. In some embodiments, expandable foams may also be utilized. In certain embodiments, various gasses may even be used as fill materials. In other embodiments, various viscous or gelatinous materials may be used as fill materials including, but not limited to, silica gel.

Furthermore, while the devices and methodologies disclosed herein have been specifically illustrated and described with reference to the production of a weighted article (and in particular, a sandbag), it will be appreciated that the methodologies and devices described herein may be used more generally to create a self-sealing container of virtually any type. As specific, non-limiting examples, this approach may be used to create self-sealing sacks, packages or containers of grain, fertilizer, chemicals, ice, and various other commodities and products. As another specific example, this approach may be utilized in food packaging applications.

Various materials may be utilized in the construction of the devices described herein. These include, without limitation, various types of fabrics such as nylon and canvas, rubber, and various types of metals and fibers. Preferably, the body of the device is constructed from a resilient or elastomeric material, and more preferably, from a neoprene/nylon laminate. Most preferably, the body of the device comprises a thick layer of neoprene with a thinner layer of nylon laminated to each side. The use of such materials in combination with a proper fill allow the device to be gripped, which is an important aspect of strength training in many applications. In some embodiments, various materials may be incorporated into the devices described herein to impart anti-soiling, anti-staining or decorative properties, or to render the devices moisture-proof, water-proof, moisture resistant, or water-resistant.

In some embodiments of the methodologies and devices described herein, after the article is filled with a suitable material, it may be permanently sealed. This may be accomplished, for example, by fusing the inlet under heat or pressure, by gluing the inlet closed, or by other suitable means known to the art.

The dimensions of the inlet may vary from one embodiment to another, and may depend in part on the overall size of the weighted article and the intended end use. Preferably, however, the inlet has sufficient dimensions such that the collapse of the inlet, as induced by the fill material, will effectively seal the fill material within the weighted article.

As used herein, the term "panel" may be interchangeable with the term "wall" and the term "sheets of material" may be interchangeable with the term "shaped portions." It will be appreciated that this is in no way limiting but merely serves to broaden the base of descriptive terms used to illustrate the present disclosure.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A plurality of exercise articles, each of the plurality of exercise articles comprising:

a body having an interior volume, the body comprising a first and a second panel of material adhered together by stitching near a periphery of the body, the stitching following a generally nonlinear pattern of stitching, the first and the second panels having a generally circular shape; and a collapsible inlet which is in open communication with said interior volume and which is movable from a first position in which it extends from said body, to a second position in which it extends into said internal volume, the inlet comprising one or more sheets of material comprising lateral edges adhered together forming one or more seams;

wherein said inlet is configured such that when the inlet is in the first position, the one or more seams are inverted;

wherein the first and second panels of at least one of the plurality of exercise articles have a larger outer diameter than first and second panels of at least one other of the plurality of exercise articles.

2. The plurality of exercise articles of claim 1, wherein said inlet is collapsible in a direction perpendicular to its longitudinal axis.

3. The plurality of exercise articles of claim 2, wherein said inlet comprises a material that readily deforms as the body is filled with a granular material.

4. The plurality of exercise articles of claim 1, wherein first lateral edges of the one or more sheets are sewn together, and wherein second lateral edges of the one or more sheets are sewn together.

5. The plurality of exercise articles of claim 4, wherein the first lateral edges of the one or more sheets are sewn together with a double stitch pattern, and wherein the second lateral edges of the one or more sheets are sewn together with a double stitch pattern.

6. The plurality of exercise articles of claim 4, wherein the one or more sheets are attached to said first panel.

7. The plurality of exercise articles of claim 1, wherein said inlet comprises a nylon fabric.

8. The plurality of exercise articles of claim 1, wherein said inlet comprises an elastomer.

9. The plurality of exercise articles of claim 1, wherein said inlet is invertible.

10. The plurality of exercise articles of claim 1, wherein said inlet is inverted when it is moved from said first position to said second position.

11. The plurality of exercise articles of claim 1, wherein said interior volume is filled with a granular material.

12. The plurality of exercise articles of claim 1, wherein said interior volume is filled with a material selected from the group consisting of liquids, sand, and metal particles.

13. The plurality of exercise articles of claim 1, wherein the first and second panels have essentially a shape selected from the group consisting of ellipsoidal or circular.

14. The plurality of exercise articles of claim 1, wherein said body is provided with an aperture, and wherein one end of said inlet is connected to said body in the vicinity of said aperture.

15. The plurality of exercise articles of claim 1, wherein said inlet is a tube.

16. The plurality of exercise articles of claim 1, wherein said plurality of exercise articles are sandbags.

17. The plurality of exercise articles of claim 1, wherein said body comprises an elastomer.

18. The plurality of exercise articles of claim 1, wherein said body comprises neoprene.

19. The plurality of exercise articles of claim 1, wherein said body comprises a laminate of nylon and neoprene.

20. The plurality of exercise articles of claim 1, wherein the plurality of exercise articles are ellipsoidal in shape.

21. The plurality of exercise articles of claim 1, wherein said body comprises a laminate of nylon and an elastomer.

22. The plurality of exercise articles of claim 1, wherein said body comprises an elastomeric substrate having a layer of nylon laminated to each side.

23. The plurality of exercise articles of claim 1, wherein the nonlinear pattern is a zig-zag pattern.

24. A plurality of exercise articles, each of the plurality of exercise articles comprising:

a body having an interior volume, the body comprising a first and a second panel of material adhered together by stitching near a periphery of the body, the stitching following a generally nonlinear pattern of stitching, the first and the second panels having a generally circular shape; and a collapsible, invertible inlet which is in open communication with said interior volume, the inlet comprising one or more sheets of material comprising lateral edges adhered together forming one or more seams;

wherein said inlet is configured such that when the inlet is positioned external from the interior volume, the one or more seams are inverted;

wherein the first and second panels of at least one of the plurality of exercise articles have a larger outer diameter than first and second panels of at least one other of the plurality of exercise articles.

25. The plurality of exercise articles of claim 24, further comprising a fill disposed in said internal volume.

* * * * *